United States Patent [19]

Riniker

[11] 4,035,593

[45] July 12, 1977

[54] FLEXIBLE PRESSURE SENSITIVE SWITCH ACTUATOR MODULE ADAPTABLE TO A KEYBOARD SURFACE HAVING FIXED CONTACT ARRAY

[75] Inventor: James P. Riniker, Sparta, Wis.

[73] Assignee: Northern Engraving Company, Inc., Sparta, Wis.

[21] Appl. No.: 620,955

[22] Filed: Oct. 9, 1975

[51] Int. Cl.[2] ..... H01H 13/00; H01H 9/00

[52] U.S. Cl. ..... 200/5 A; 200/159 B; 200/294; 200/308; 200/329

[58] Field of Search ..... 200/5 R, 5 A, 159 B, 200/308, 314, 317, 86 R, 293–296, 329, 340; 428/40; 174/68.5

[56] References Cited

U.S. PATENT DOCUMENTS

| | | | |
|---|---|---|---|
| 3,538,389 | 11/1970 | Levesque et al. | 174/68.5 X |
| 3,591,749 | 7/1971 | Comstock | 200/308 |
| 3,627,927 | 12/1971 | Schmitz et al. | 200/159 B UX |
| 3,718,791 | 2/1973 | Szablowski | 200/86 R X |
| 3,732,389 | 5/1973 | Kaelin et al. | 200/159 B X |
| 3,769,869 | 11/1973 | Nelson, Jr. | 200/159 B X |
| 3,811,025 | 5/1974 | Bach | 200/317 |
| 3,860,771 | 1/1975 | Lynn et al. | 200/5 A |
| 3,862,382 | 1/1975 | Glaister et al. | 200/5 A |
| 3,886,012 | 5/1975 | Slater | 200/5 A X |

OTHER PUBLICATIONS

184 USPA 707, Circuit-Stik, Inc. et al.

*Primary Examiner*—James R. Scott
*Attorney, Agent, or Firm*—Norman Lettvin; Gerald S. Geren

[57] ABSTRACT

A flexible, self-biasing switching element is disclosed herein for closing a circuit by flexing the element from an initial non-contacting position to a second contacting position and for opening the circuit by releasing the element and permitting it to return to a non-contacting position from the contacting position. The element includes a flexible non-conductive substrate having on one side thereof a plurality of spaced conductive contacts or areas. A two-sided pressure sensitive adhesive film for mounting the element is die cut and applied to the substrate in a manner so as to surround the conductive contact areas. The adhesive film provides an insulating medium between the contact points so as to prevent transmission of current between the contact points.

1 Claim, 3 Drawing Figures

FIG. 1
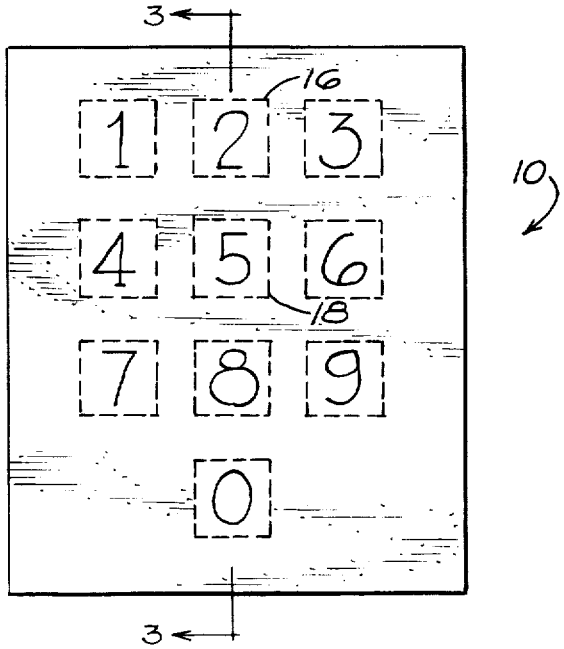
10
FIG. 2
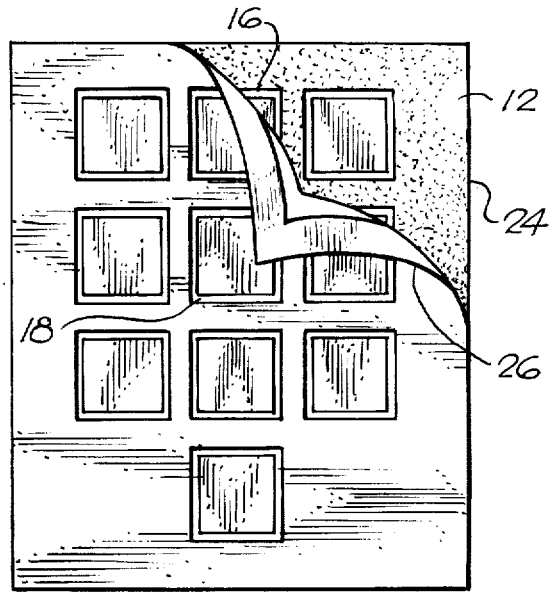
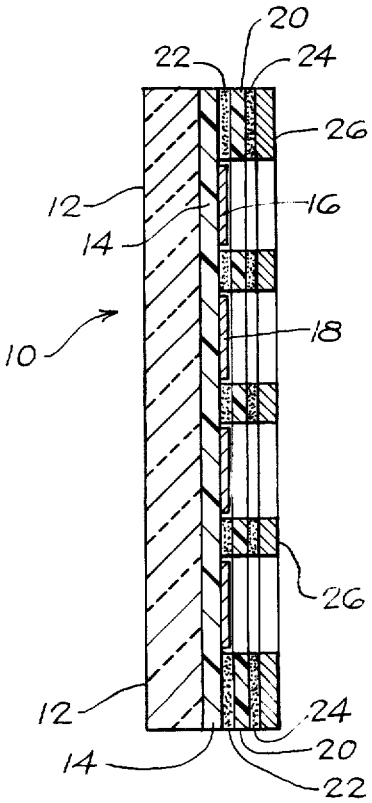
FIG. 3

FLEXIBLE PRESSURE SENSITIVE SWITCH ACTUATOR MODULE ADAPTABLE TO A KEYBOARD SURFACE HAVING FIXED CONTACT ARRAY

BACKGROUND OF THE INVENTION

This invention relates to electrical switching elements, and more particularly, to a flexible electrical switching element.

In many situations it is desirable to provide a decorative and reliable switching element which can be applied to flat surfaces, such as a dashboard or telephone base. Mechanical switches are well known but do not provide the desired appearance and may be unreliable in that dirt can cause clogging of the switching mechanism.

Moreover, in most applications it is desirable that the element be of simple design and inexpensive to manufacture.

It is therefore an object of this invention to provide a decorative and reliable switching element which is of simple design and inexpensive to manufacture.

These and other objects will become apparent from the following description and appended claims.

SUMMARY OF THE INVENTION

There is provided by this invention a flat, decorative, one-piece switching element which meets the foregoing objects. The element includes a flexible substrate having electrical contact areas thereon which are aligned in cooperative relationship with indicia on the substrate. The indicia provides information as to the circuits activated by pressing the indicia. The substrate is of a flexible, non-conducting material and the contact areas are of silver. A combination insulator and bonding agent is applied to the substrate for separating the contact areas so as to prevent electrical communication between the contact areas and for mounting the switching element to the desired surface.

BRIEF DESCRIPTION OF THE DRAWINGS

FIG. 1 is a front view of a switching element;

FIG. 2 is a back view of a switching element with portions of the element peeled back; and FIG. 3 is a greatly enlarged cross-sectional view taken substantially along line 3—3 showing the various layers of the switching element.

DESCRIPTION OF THE PREFERRED EMBODIMENT

Referring now to the drawings, there is shown a switching element 10 generally, which has 10 separate switching areas designated by the numerals 0–9, inclusive.

The element 10 includes a flexible, non-conducting plastic substrate 12, such as Mylar, which is preferably transparent. A decorative ink flim 14 is printed on one side of the substrate 12 and it includes the numerals 0–9.

Silver contact areas, such as 16 and 18, are printed on the decorative film 14 in alignment with the numerals, such as numbers 2 and 5. The contact areas, such as 16 and 18, are spaced from one another and are adapted to contact and complete electrical circuits (not shown).

A two-sided pressure sensitive adhesive film, which includes a central Mylar sheet 20 approximately 0.001 inches thick having adhesive 22 and 24 on either side and a paper release layer 26, is die cut so as to provide apertures or openings that can be aligned with the silver contact areas.

The die-cut pressure sensitive adhesive film and paper release layer are applied to the printed film so as to expose the silver contact area in the apertures formed in the release layer and adhesive layer. The adhesive and Mylar cooperate in insulating and isolating the contact areas from each other and for preventing transient electrical currents from communicating between the respective contact areas.

The substrate coupled with the adhesive and Mylar layer is flexible and resilient so that any one of the contact areas can be pressed to complete the appropriate circuit and when released pops or snaps back to the initial non-contacting position.

This particular switching element is inexpensive to manufacture in that it is capable of being manufactured by a printing process. In such a process, the substrate 12 is passed through an appropriate printing roll so as to apply the ink film 14. Passing the already printed substrate to another set of printing roll can apply the silver contact areas 16 and 18. Then the die-cut pressure sensitive adhesive and release layer can be also applied.

As can be seen from the foregoing, this switching element is an one-piece construction which combines the features of low manufacturing cost, simplicity of manufacture and reliability.

The switching element 10 can be used in many applications. For example, the contacts can be used in a normal telephone system where the two contact points are positioned under the respective numerals. Upon depressing of the numeral, for example 5, the circuit thereunder would be closed so as to provide the necessary communication of information to the telephone switching circuit. Release of the 5 reopens the circuit and then the next in the series of numbers could be depressed. Similarly, the element could be used in other applications where a flat surface is generally desirable.

It will be appreciated that numerous changes and modifications can be made to the embodiment disclosed herein without departing from the spirit and scope of this invention.

What is claimed and desired to be secured by Letters Patent of the United States is:

1. A unitary, self-biasing, flexible switching element constructed for mounting on a flat surface, said element comprising:

1. a substantially planar, transparent, flexible and electrically non-conductive substrate;
2. ink layer means formed directly on said substrate;
3. a plurality of discrete, spaced and electrically conductive contact area means carried on the side of said ink layer means opposite the substrate; and
4. insulating and bonding means bonded to the same side of said ink layer means as the contact area means and in surrounding relationship with each of said contact area means for cooperation in electrically insulating said contact area means from each other and for bonding said switching element to a surface, said insulating and bonding means including:

a. a central, flexible, and non-conductive layer, b. a pair of adhesive layers, one on each side of said central layer, one of said adhesive layers for bonding to said ink layer means and the other of said adhesive layers for bonding to a flat surface, and c. a plurality of apertures of substantially the same size and shape as each of the contact area means formed in the insulating and bonding means so that the contact area means are exposed by the apertures;

said ink layer means including indicia aligned with and in overlying relationship to each of said contact area means for indicating a circuit that will be closed by flexing said substrate from an initial non-conducting position to a second contacting position, and opened by releasing the substrate and permitting it to move from said contacting position to said non-contacting position.

* * * * *